US007775265B2

(12) United States Patent
Chissus

(10) Patent No.: US 7,775,265 B2
(45) Date of Patent: Aug. 17, 2010

(54) SIDE TANK DESIGN

(75) Inventor: Lisa L. Chissus, Tacoma, WA (US)

(73) Assignee: Flex-A-Lite Consolidated, Inc., Fife, WA (US)

( * ) Notice: Subject to any disclaimer, the term of this patent is extended or adjusted under 35 U.S.C. 154(b) by 442 days.

(21) Appl. No.: 10/941,330

(22) Filed: Sep. 15, 2004

(65) Prior Publication Data

US 2006/0081363 A1 Apr. 20, 2006

(51) Int. Cl.
*F28F 9/02* (2006.01)
*B60K 11/04* (2006.01)

(52) U.S. Cl. ..... 165/173; 165/78

(58) Field of Classification Search ..... 165/67, 165/78–79, 173, 176, 178; 123/41.51; 180/68.4
See application file for complete search history.

(56) References Cited

U.S. PATENT DOCUMENTS 3,086,627 A * 4/1963 Bernard ..... 52/474
3,462,110 A * 8/1969 Cheslock ..... 248/219.4
4,478,306 A 10/1984 Tagami ..... 180/229
4,678,026 A 7/1987 Lenz et al.
5,139,080 A 8/1992 Bolton et al. ..... 165/67
5,163,507 A 11/1992 Joshi ..... 165/135
5,205,349 A 4/1993 Nagao et al. ..... 165/67
5,445,219 A * 8/1995 Hutto et al. ..... 165/173
5,450,896 A * 9/1995 Bertva et al. ..... 165/173
6,059,322 A * 5/2000 Nagai et al. ..... 285/125.1
6,158,500 A * 12/2000 Heine ..... 165/67
6,293,011 B1 * 9/2001 Hasegawa et al. ..... 29/890.052
6,533,027 B2 * 3/2003 Gille et al. ..... 165/67
7,044,203 B2 * 5/2006 Yagi et al. ..... 165/122
2001/0050160 A1 * 12/2001 Ozawa et al. ..... 165/67
2003/0230397 A1 * 12/2003 Southwick et al. ..... 165/67
2004/0031598 A1 * 2/2004 Shimanuki et al. ..... 165/164

FOREIGN PATENT DOCUMENTS

JP 63271099 A * 11/1988
JP 2002168584 6/2002

OTHER PUBLICATIONS

Be Cool Buyer's Guide, 21st Century Radiator Module Systems, Form #0112, date unknown.
Be Cool Brochure, 2001 Radiator Module Systems (distributed by Summit Racing Equipment), date unknown.
U.S. Radiator Performance Cooling Catalog (76 numbered pages+front insert+front cover+back cover), date unknown.
FLUIDYNE High Performance online catalog (18 pages+front cover+back cover), date unknown.
Griffin Thermal Products @ www.griffinrad.com, date unknown.
AG Race Truck @ www.northernfactory.com, date unknown.
Howe Racing Enterprises @ www.howeracing.com, date unknown.

* cited by examiner

*Primary Examiner*—Tho v Duong
(74) *Attorney, Agent, or Firm*—Fitch, Even, Tabin & Flannery; John M. Naber

(57) ABSTRACT

A cooling system for a reciprocating engine includes a main cooling device and a side tank. The main cooling device includes at least one heat dissipation tube that contains an internal fluid for transporting excess heat developed by a reciprocating engine. The side tank is attached to the main cooling device and includes a plurality of exterior fins for dissipating heat to cool airflow. The exterior fins form an adjustable mounting location.

13 Claims, 6 Drawing Sheets

SIDE TANK DESIGN

FIELD OF THE INVENTION

The present invention relates generally to a cooling system for a reciprocating engine, and in particular to a radiator core having a side tank that provides enhanced heat dissipation and an adjustable mounting system.

BACKGROUND OF THE INVENTION

Cooling systems such as radiators, engine oil coolers, inner coolers, and transmission oil coolers, have always been an essential component of internal combustion engines, such as engines used in automobiles and boats. The cooling systems are sold both as original equipment and as aftermarket replacements or upgrades. When the cooling systems are sold in the aftermarket, they are sold as either direct-fit replacement units, which are tailored to a particular vehicle, or as universal-fit replacement units, which require custom mounting.

Direct-fit replacement units have existing fixed mounting points that align to the mounting points of a vehicle, which can be located on an engine of the vehicle. The direct-fit replacement units, however, do not provide adjustability in the mounting points. Thus, any manufacturing misalignments would greatly hinder the assembly of the unit. Similarly, attempting to modify the engine can result in clearance problems when assembling necessary cooling components.

Universal-fit replacement units have no predetermined mounting points, wherein vehicle-specific mounting points are typically provided by welding a custom bracket to the unit body. One problem with this type of mounting system is that it does not provide means for easily adjusting the mounting points after the bracket has been welded to the unit body.

In the case of radiators and some oil coolers, in addition to mounting the cooling system onto a vehicle, accessories such as fans, air-conditioning condensers, oil coolers, or other smaller cooling component elements may be mounted onto the cooling system itself. One method of attaching these accessories is by using internal ties. The ties are generally inserted through thin cooling fins of the main cooling device, e.g., the radiator core, and tightened onto the accessory in order to hold the accessory and the radiator together. Unfortunately, the ties have a tendency to damage the thin cooling fins and to subsequently reduce the efficiency of the cooling device. The alternative to the ties is to use either another fixed mounting point, which has been welded to the main cooling device, or to drill an additional fixed mounting point in the existing mounting bracket. Nevertheless, neither alternative option provides adjustability after an initial mounting point has been fixed.

A purpose of cooling systems is to cool a fluid, such as an engine coolant. In the case of radiators, an inlet side tank distributes the fluid to a series of tubes of a radiator core, wherein heat from the fluid is dissipated in part via fins attached to the tubes. Upon exiting the tubes, the fluid is collected in and expelled through an outlet side tank.

The available space for a cooling device, such as a radiator, is determined by the design of an original equipment manufacturer. Maximizing the heat rejection of the cooling device within the available space results in a more efficient heat transfer. A more efficient heat transfer is desirable because it can result in a higher engine performance, e.g., it can allow the increase of horsepower. In general, the cooling function in current systems is performed mostly by the radiator core, wherein the side tanks have marginal cooling capability.

Thus, one problem associated with current cooling systems is that they do not maximize the available cooling space.

Thus, there is a need to overcome problems associated with current cooling systems. The present invention is directed to satisfying these and other needs.

SUMMARY OF THE INVENTION

A cooling system for a reciprocating engine includes a main cooling device and a side tank. The main cooling device includes at least one heat dissipation tube that contains an internal fluid for transporting excess heat developed by a reciprocating engine. The side tank is attached to the main cooling device and includes a plurality of exterior fins for dissipating heat to cool airflow. The exterior fins form an adjustable mounting location.

In an alternative aspect of the present invention, a radiator for a reciprocating engine includes a radiator core and an extruded side tank. The side tank is attached to the radiator core and is configured to receive a cooling fluid from the radiator core.

In another aspect of the present invention, a method for assembling a cooling system for a reciprocating engine includes providing a main cooling device. The main cooling device includes at least one heat dissipation tube, which contains an internal fluid for transporting excess heat developed by a reciprocating engine. The method further includes attaching a side tank to the main cooling device. The side tank has a plurality of exterior fins for adjustably securing an attachment device to an adjustable mounting location of the exterior fins.

The above summary of the present invention is not intended to represent each embodiment, or every aspect, of the present invention. Additional features and benefits of the present invention are apparent from the detailed description, figures, and claims set forth below.

Figure 1:
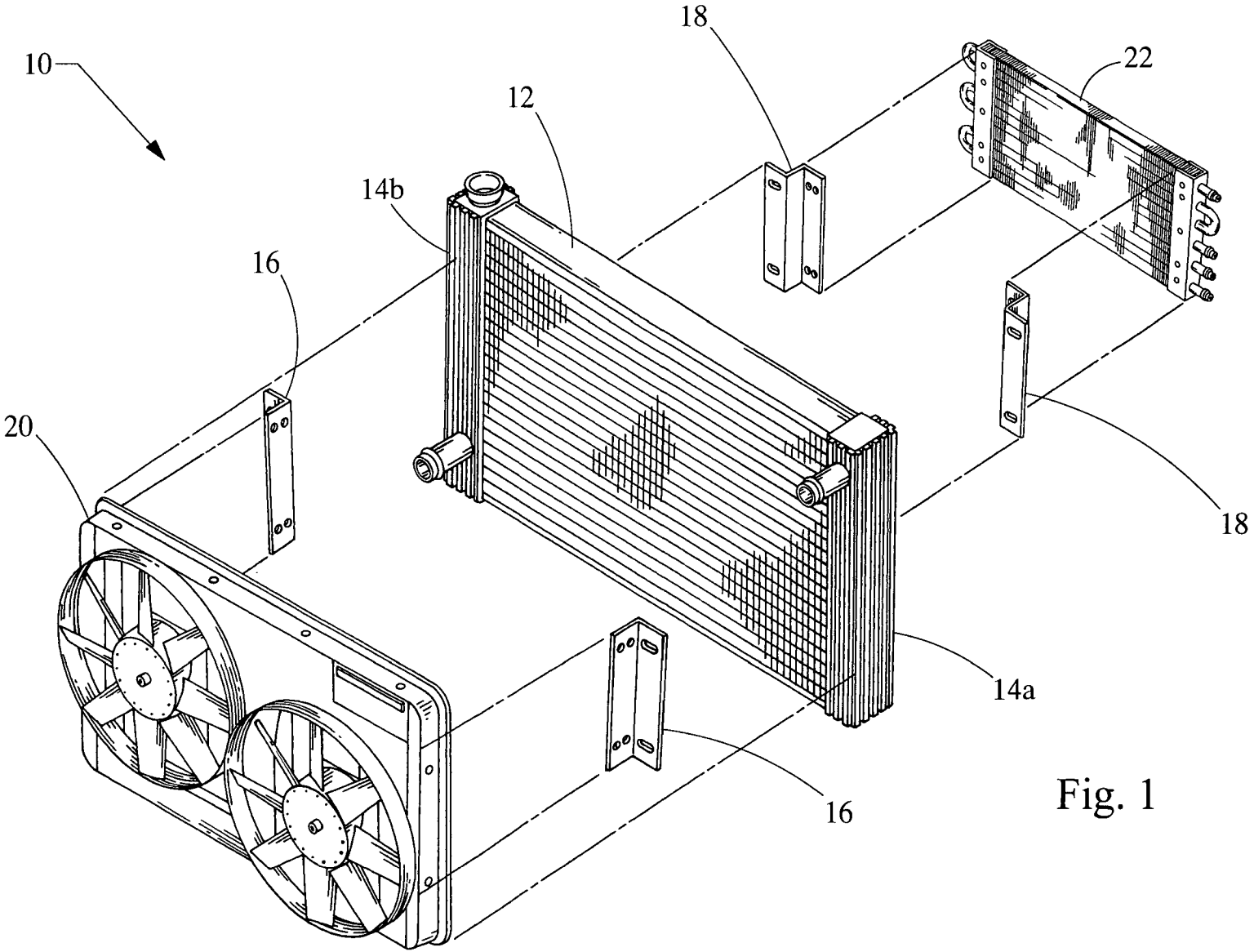
FIG. 1 illustrates an exploded view of an automotive cooling system in accordance with the present invention.

While the invention is susceptible to various modifications and alternative forms, specific embodiments are shown by way of example in the drawings and are described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Referring to FIG. 1, a cooling system 10 includes a main cooling device 12, sometimes referred to as the core, an inlet side tank 14*a*, and an outlet side tank 14*b*. The cooling system 10 is generally used in internal combustion engines of moving or stationary vehicles, such as automobiles, motorcycles, boats, and power-generators. The engine is also known as a reciprocating engine, and it can be fueled by gasoline, diesel, propane, or any other combustible material.

Figure 8:
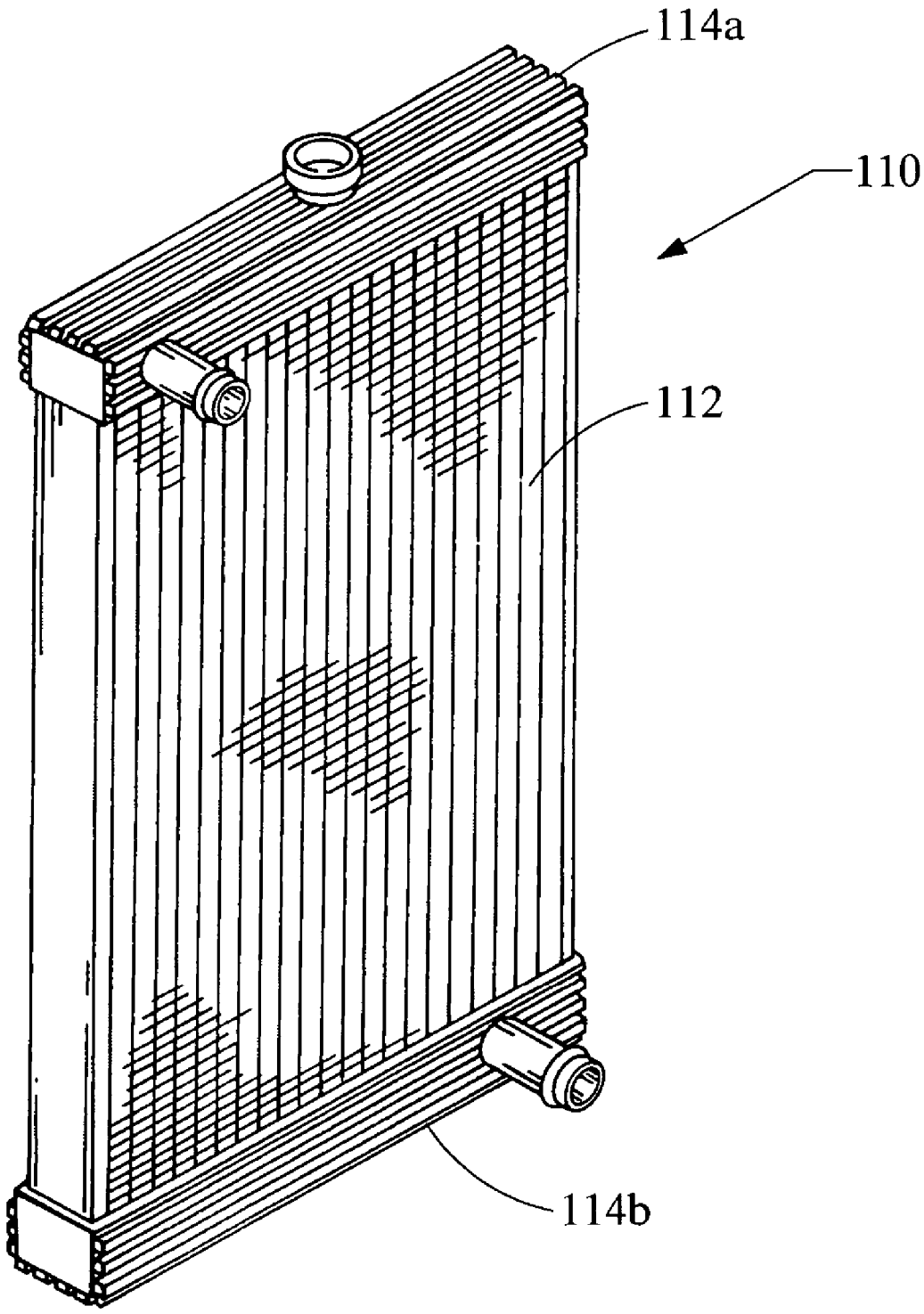
FIG. 8 illustrates a perspective view of a down-flow configuration of an automotive cooling system, according to another embodiment of the present invention.

The cooling system 10 can be provided in either a cross-flow configuration (shown in FIG. 1) or in a down-flow configuration (shown in FIG. 8). For example, a cooling system 10 can be a radiator, an engine oil cooler, a transmission oil cooler, an inner cooler, a charge air cooler, a power steering fluid core, a hydraulic pump fluid cooling core, a fuel cooler, or a condenser. Using additional brackets 16, 18 other accessories, such as a cooling fan 20 and an oil cooler 22, can be mounted to the cooling system 10.

Existing cooling systems are attached to a vehicle using fixed mounting points. For example, some cooling systems are manufactured with a fixed mounting point that is used for attaching the cooling system to a vehicle. Other cooling systems are manufactured without any fixed mounting points, wherein a bracket assembly is welded to provide a mounting point for attaching the cooling system to a vehicle. Neither type of cooling system provides adjustability in the mounting process. In contrast, the cooling system 10 of the present invention is mounted to a vehicle device, such as an engine, using an adjustable mounting location that is integrated in the side tanks 14*a*, 14*b*. In addition, other accessories, such as cooling hardware, can be adjustably mounted to the side tanks 14*a*, 14*b*. Further, the present invention allows pre-assembly of the cooling system 10 for easy installation at a factory. The mounting of the cooling system 10 to other devices, and of accessories to the cooling system 10, will be described in more detail below.

Figure 2:
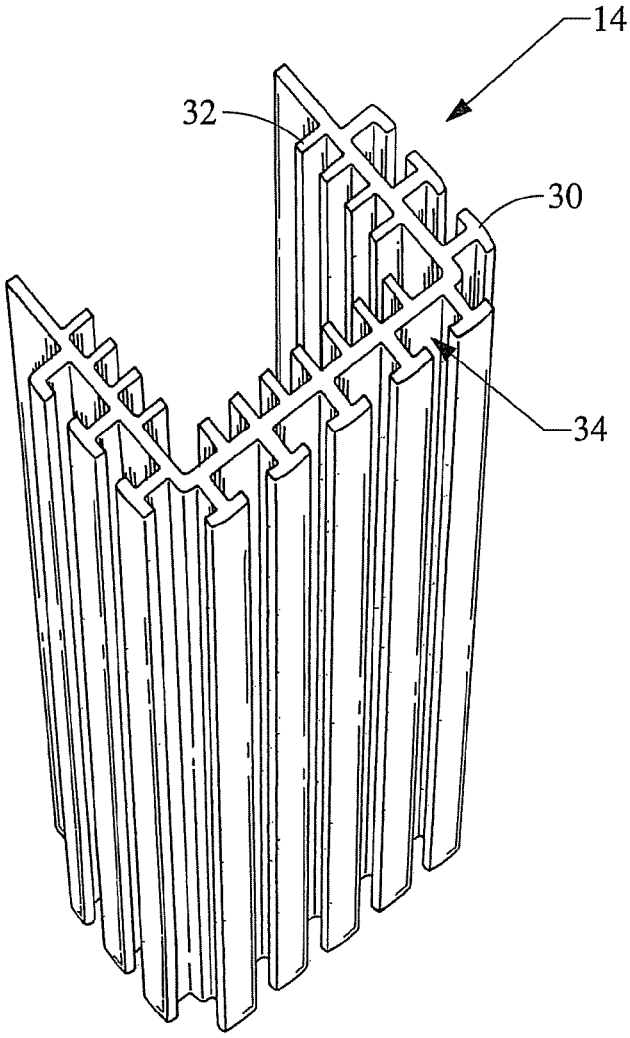
FIG. 2 illustrates a perspective view of a side tank of the automotive cooling system of FIG. 1.
Figure 3:
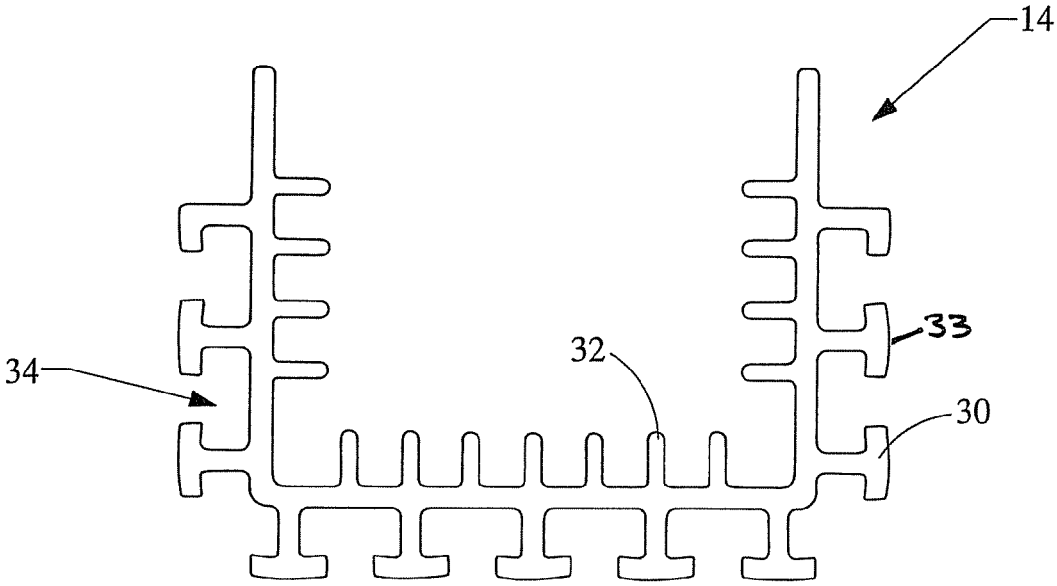
FIG. 3 illustrates a top view of the side tank of FIG. 2.

Referring now to FIGS. 2 and 3, the structure of the side tanks 14*a*, 14*b* will be described in more detail. Because in general, although not necessarily, the structure of the inlet side tank 14*a* and the outlet side tank 14*b* is similar, the generic term side tank 14 will be used hereinafter when referring to the inlet side tank 14*a* and the outlet side tank 14*b*. The side tank 14 has a generally "C" or "U" shape that includes three sides, each side having an exterior surface and an interior surface. Each side has a plurality of exterior fins 30, which are integrally attached to the exterior surface, and a plurality of interior fins 32, which are integrally attached to the interior surface.

The exterior fins 30 are formed to create one or more slotted channels 34, preferably having a "T-channel" or "C-channel" configuration. The exterior fins 30 are used for mounting purposes, as described in more detail below, and for cooling purposes. The number and geometry of the exterior fins 30 is determined, based on a specific application, to maximize mounting adjustability and heat dissipation. The exterior fins 30, in one embodiment, include arched tops 33.

The interior fins 32, similarly to the exterior fins 30, help in enhancing the cooling capability of the cooling system 10. The number and geometry of the interior fins 32 is determined to maximize heat dissipation for a specific application. Thus, both the exterior fins 30 and the interior fins 32 act as heat sinks for removing heat from the cooling system 10. For example, to remove heat from the cooling system 10, the heat transfer mediums include a water-to-air transfer, an oil-to-air transfer, an oil-to-water transfer, and an air-to-air transfer.

The side tanks 14*a*, 14*b* are preferably manufactured using an extrusion process, using high-strength materials such as aluminum alloys. For example, one preferred high-strength aluminum alloy is 6061-T6. This type of material provides both a strong structure for mounting hardware and an excellent conductor of heat. Some existing cooling tanks are made using a plastic material, which acts as an insulator and does very little to dissipate heat. In contrast, the cooling system 10 of the present invention is preferably manufactured with extruded aluminum. The conductive nature of aluminum, coupled with the added surface area provided by fins such as the exterior fins 30 and the interior fins 32, greatly enhances heat acquisition and, then, heat dissipation.

In other embodiments, the side tanks 14*a*, 14*b* are manufactured using a cast process or a draw-forming process. Further, the material of the side tanks 14*a*, 14*b* can be alternatively selected from a group including at least one of a copper, brass, iron, and steel material. Optionally, the material of the side tanks 14*a*, 14*b* can be a plastic that is impregnated with heat-disseminating materials.

Figure 4:
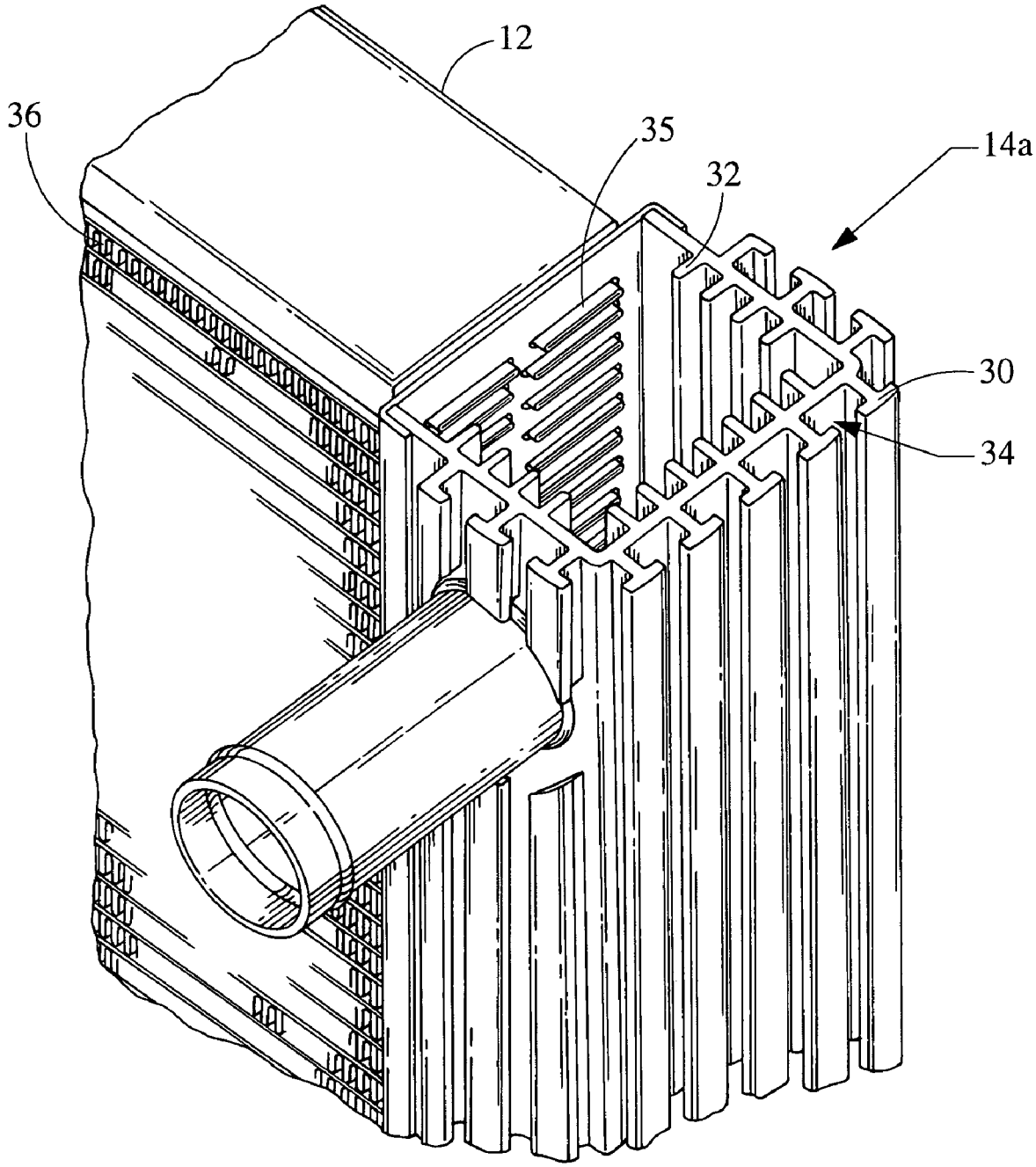
FIG. 4 illustrates an enlarged cutaway view of a side tank section of the automotive cooling system of FIG. 1.

Referring now to FIG. 4, the side tank 14*a* is permanently attached to the main cooling device 12. For example, both side tanks 14*a*, 14*b* are welded to the main cooling device 12 to form a manifold for distributing coolant to the main cooling device 12. As shown, the main cooling device 12 has a plurality of heat dissipation tubes 35 that are oriented along its length, with one end of the dissipation tubes 35 starting in the inlet side tank 14*a* and one end ending in the outlet side tank 14*b*. The dissipation tubes 35 carry an internal cooling fluid from the inlet side tank 14*a*, through the main cooling device 12, to the outlet side tank 14*b*. The cooling fluid can include either a liquid, air, or both. The heat dissipation tubes 35 are generally in contact with one or more fins 36 which serve to remove additional heat from the heat dissipation tubes 35.

The interior fins 32 of the side tanks 14 are configured so as to be in contact with the internal fluid when the fluid is flowing through the cooling system 10. Due to their large surface area, the interior fins 32 remove heat from the internal fluid more rapidly than a smooth interior surface. Similarly, due to their large surface area, the exterior fins 30 act as heat sinks and dissipate heat from the side tanks 14 to the outside atmosphere more effectively than a flat surface. Thus, the exterior fins 30 dissipate heat to cool airflow to a device such as a reciprocating engine.

Figure 5:
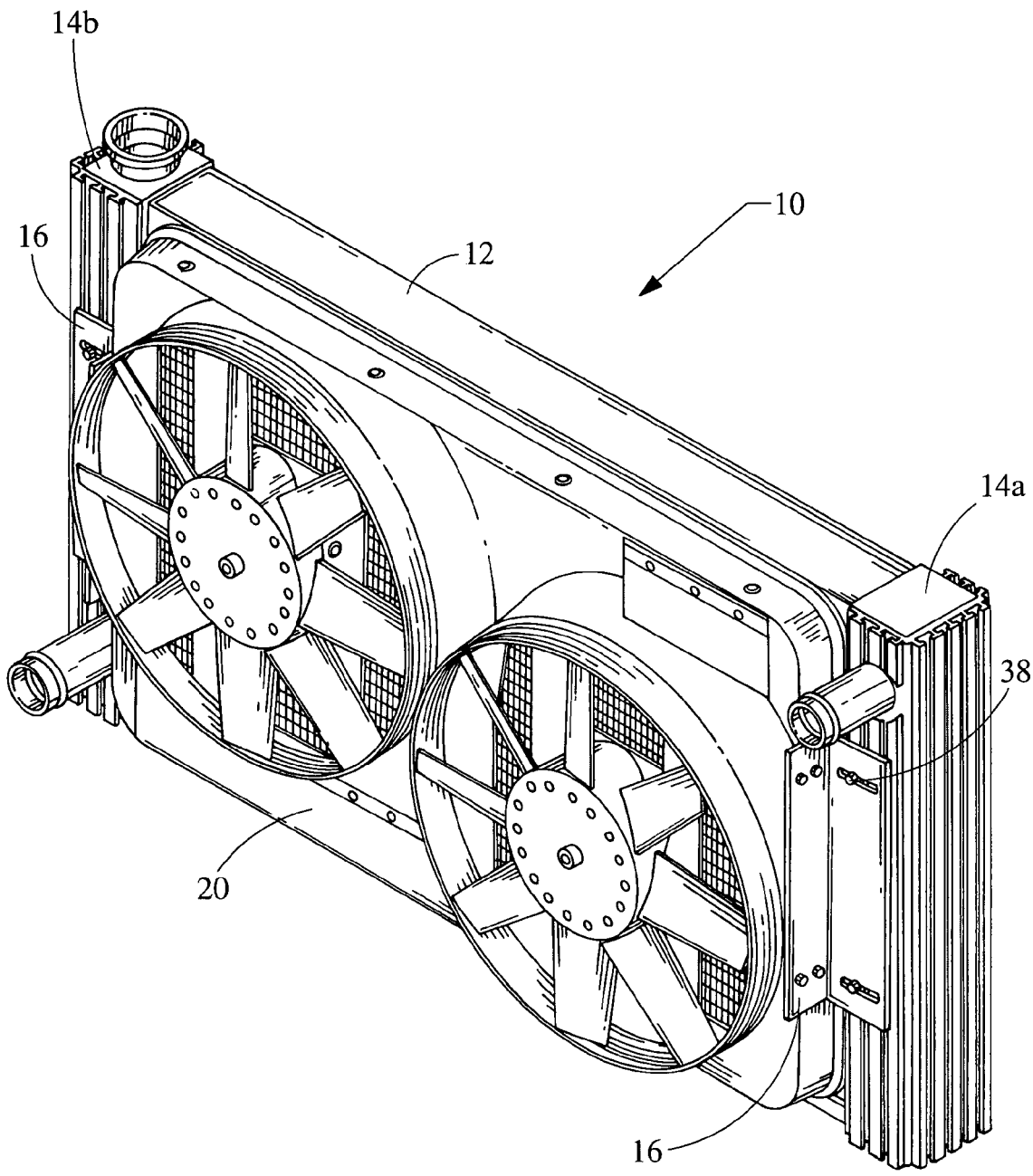
FIG. 5 illustrates a perspective view of the automotive cooling system of FIG. 1.

Referring now to FIG. 5, the side tanks 14 are used to mount the cooling fan 20 to the main cooling device 12. A bracket 16 is attached to the inlet side tank 14*a* and to one side of the cooling fan 20, while another bracket 16 is attached to the outlet side tank 14*b* and to another side of the cooling fan 20. The brackets 16 are attached to the side tanks 14 using an attachment device 38. The attachment device 38, according to one embodiment of the present invention, is a nut and bolt combination. Either one of the nut or bolt is inserted and adjusted into one of the channels 34, wherein the nut-bolt combination is thereafter tightened to secure the bracket 16 to the side tank 14.

In contrast to prior cooling systems, accessories such as the cooling fan 20 can be easily adjusted in the desired position via the adjustable mounting location positioned on each of the side tanks 14. Thus, the present invention allows more flexibility in assembling the cooling system 10 to other parts of a vehicle, or in assembling accessories to the cooling system 10.

Figure 6:
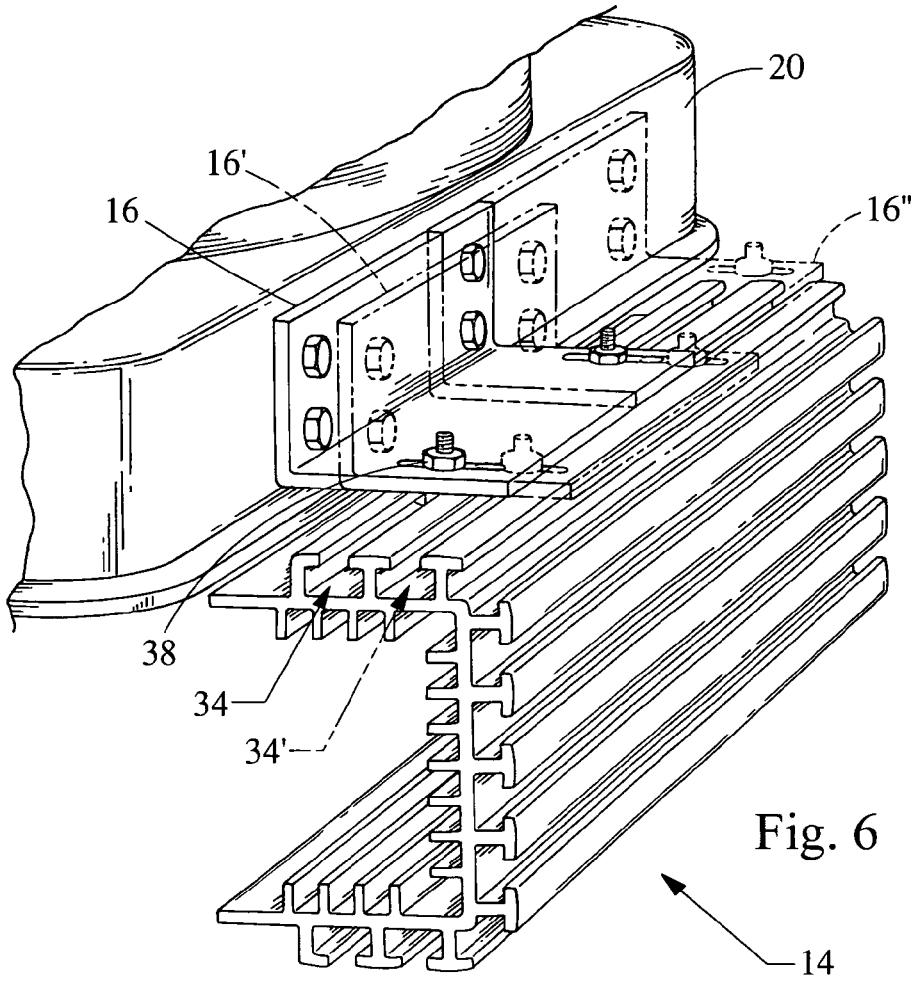
FIG. 6 illustrates a perspective view of an adjustable bracket assembly mounted to a side tank, according to an alternative embodiment of the present invention.
Figure 7:
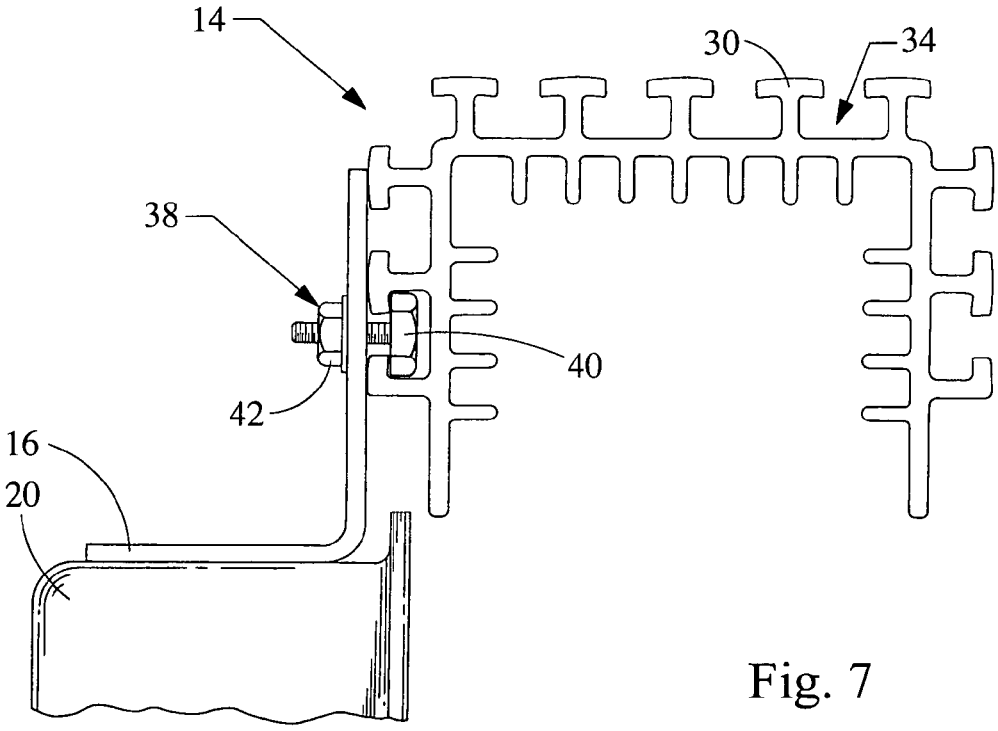
FIG. 7 illustrates a side view of FIG. 6.

Referring now to FIGS. 6 and 7, the slotted channels 34, which are formed by the exterior fins 30 of the side tank 14, serve as an adjustable mounting location for attaching the cooling system 10 to the vehicle. The slotted channels 34 also serve as an adjustable mounting location for the bracket 16 to attach accessories or hardware such as the cooling fan 20.

The bracket 16 can be adjusted along an x-axis, which is oriented in a perpendicular direction to the channels 34, and along a y-axis, which is oriented in a parallel direction to the channels 34. To adjust the bracket 16 along the x-axis from a first position 16 to a secondary position 16', the attachment 38 is moved from a first channel 34 to a second channel 34'. Similarly, if adjustment is desired along the y-axis, the attachment 38 is slidably moved along the channel 34 to the desired location such that the bracket 16 is moved from the first position 16 to another secondary position 16".

In one embodiment of the present invention, shown in FIG. 7, the attachment device 38 includes a hex-head bolt 40 and a nut 42. After having the hex-head of the bolt 40 captured within a channel 34, the nut 42 is tightened on the other end of the bolt 40 to secure the bracket 16 in a desired location on the side tank 14. The exterior fins 30, which form the slotted channels 34, provide an adjustable mounting location for the head of the bolt 40, wherein the head of the bolt 40 can be placed anywhere along a channel 34.

In general, the bolt 40 has a head that fits flatly and snugly against the walls of the exterior fins 30, such that the head of the bolt 40 does not rotate when the nut 42 is tightened onto the bolt 40. For example, in one embodiment the channel 34 is large enough to capture a standard ¼ inch or 6 millimeter bolt/nut. Alternatively, the attachment device 38 includes a square-head bolt and nut combination. Optionally, the attachment device 38 can include any fastener that can be captured within one of the slotted channels 34.

Referring now to FIG. 8, a cooling system 110 is configured in a down-flow configuration, according to another embodiment of the present invention. The cooling system 110 includes a main cooling device 112, an inlet side tank 114*a*, and an outlet side tank 114*b*. The inlet side tank 114*a* is located at the top of the main cooling device 112, while the outlet side tank 114*b* is located at the bottom of the main cooling device 112.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A cooling system, comprising:

a cooling device including a plurality of fins disposed between a plurality of heat dissipation tubes; and at least one side tank defining a chamber and in fluid communication with the plurality of heat dissipation tubes, the at least one side tank having exterior T-shaped fins, said T-shaped fins are sized and shaped to define a T-channel extending substantially an entire length of said at least one side tank and the T-channel is adapted to capture a fastener and prevent said fastener from rotating while allowing the fastener to be slidably adjusted along the length of the T-channel.

2. The cooling system of claim 1, comprising two side tanks.

3. The cooling system of claim 1, wherein said side tank further includes at least one interior fin.

4. The cooling system of claim 1, wherein said exterior fins are made from a heat conducting material for enhancing cooling characteristics of said cooling system.

5. The cooling system of claim 1, wherein said main cooling device and said side tank form a radiator configuration selected from a group including a cross-flow configuration and a down-flow configuration.

6. A method for assembling a cooling system, comprising:

providing a main cooling device including a plurality of fins disposed between a plurality of heat dissipation tubes; and attaching a side tank to said main cooling device, wherein said side tank is adapted to allow an internal fluid to transfer between said side tank and said a plurality of heat dissipation tubes, further wherein said side tank has a plurality of exterior fins, wherein said exterior fins are T-shaped and form at least two T-channels extending substantially an entire length of said side tank, each said T-channel being sized and shaped to capture a fastener and prevent said fastener from rotating while allowing the fastener to be slidably adjusted along the length of the T-channel and releasably secured thereto with a removable attachment device.

7. The method of claim 6, wherein said side tank further includes at least one interior fin.

8. The cooling system of claim 1, wherein the side tank has at least two T-channels on each of three sides of said side tank.

9. The method of claim 6, wherein the side tank has at least two T-channels on each of three sides of said side tank.

10. The cooling system of claim 1, wherein each of said plurality of exterior T-shaped fins has an arched top.

11. The cooling system of claim 1, wherein said fastener includes at least a bolt head or a nut.

12. The method of claim 6, wherein said fasteners includes at least a bolt head or a nut.

13. The cooling system of claim 1, wherein said at least one side tank has rectilinear sides and is made from a heat conducting material for enhancing cooling characteristics of said cooling system.

* * * * *